US010865967B1

(12) United States Patent
Baker et al.

(10) Patent No.: US 10,865,967 B1
(45) Date of Patent: Dec. 15, 2020

(54) RECONFIGURABLE VEHICLE CONTROL SYSTEM

(71) Applicant: Emergency Technology, Inc., Hudsonville, MI (US)

(72) Inventors: Douglas V. Baker, Middleville, MI (US); Michael Walma, Hudsonville, MI (US); Brandon Jacobsen, Hudsonville, MI (US); David Cloud, Walker, MI (US); Jonathan Lavelette, Hudsonville, MI (US)

(73) Assignee: Emergency Technology, Inc., Hudsonville, MI (US)

( * ) Notice: Subject to any disclaimer, the term of this patent is extended or adjusted under 35 U.S.C. 154(b) by 656 days.

(21) Appl. No.: 15/477,243

(22) Filed: Apr. 3, 2017

Related U.S. Application Data

(60) Provisional application No. 62/317,925, filed on Apr. 4, 2016.

(51) Int. Cl.

| | |
|---|---|
| ***F21V 21/00*** | (2006.01) |
| ***F21V 23/00*** | (2015.01) |
| ***F21V 21/14*** | (2006.01) |
| ***F21S 2/00*** | (2016.01) |
| ***F21S 43/00*** | (2018.01) |

(52) U.S. Cl.
CPC ..... *F21V 23/001* (2013.01); *F21S 2/005* (2013.01); *F21S 43/00* (2018.01); *F21V 21/145* (2013.01); *F21V 23/003* (2013.01)

(58) Field of Classification Search
CPC ..... F21V 23/001; F21V 21/34; B60Q 1/305; B60Q 2900/30; B60Q 1/2661; B60Q 7/02; B60R 16/0207; B60R 16/03; F21S 43/195
USPC ..... 174/72; 280/422; 340/815.4, 425.5, 431, 340/438, 463, 468, 472, 473, 475, 479
See application file for complete search history.

(56) References Cited

U.S. PATENT DOCUMENTS

| | | | | |
|---|---|---|---|---|
| 3,385,989 | A | 5/1968 | Vogelpohl | |
| 4,114,789 | A | 9/1978 | Blaylock et al. | |
| 4,182,532 | A * | 1/1980 | Walker, Sr. | B61D 29/00 16/94 R |
| 4,261,614 | A * | 4/1981 | Rice | B60P 3/34 254/276 |
| 4,981,363 | A | 1/1991 | Lipman | |
| 5,736,925 | A * | 4/1998 | Knauff | B60Q 1/2611 340/463 |
| 6,000,811 | A | 12/1999 | Bordak | |
| 6,034,599 | A * | 3/2000 | Beacom | B60Q 1/305 340/431 |

(Continued)

FOREIGN PATENT DOCUMENTS

| | | |
|---|---|---|
| WO | 2014/144477 | 9/2014 |

OTHER PUBLICATIONS

Ford Fleet, Police & Special Services Vehicles 2017 Brochure, North American Fleet, Lease & Remarketing Dperations, published 2016, www.ford.com/fordpoliceinterceptor.

(Continued)

*Primary Examiner* — William J Carter
*Assistant Examiner* — Omar Rojas Cadima
(74) *Attorney, Agent, or Firm* — Warner Norcross + Judd LLP

(57) ABSTRACT

A modular electrical system for a plurality of accessories disposable on a support structure. In one embodiment, the support structure is a reconfigurable support system, such as a reconfigurable auto carrier.

21 Claims, 8 Drawing Sheets

(56) References Cited

U.S. PATENT DOCUMENTS

| | | | | |
|---|---|---|---|---|
| 6,289,822 | B1 | 9/2001 | Black, Jr. et al. | |
| 6,511,216 | B2 | 1/2003 | Strickland | |
| 6,805,523 | B2 | 10/2004 | Burke et al. | |
| 6,968,736 | B2 | 11/2005 | Lynam | |
| 7,036,965 | B2 | 5/2006 | Dalton, Jr. et al. | |
| 7,268,693 | B2 * | 9/2007 | Bell | B60Q 1/305 340/425.5 |
| 7,551,102 | B1 * | 6/2009 | Carson | B60Q 1/52 340/474 |
| 8,508,384 | B2 | 8/2013 | Uken et al. | |
| 8,714,375 | B2 | 5/2014 | Peach et al. | |
| 9,283,887 | B1 | 3/2016 | Carpenter et al. | |
| 2001/0024371 | A1 | 9/2001 | Pastrick et al. | |
| 2004/0109313 | A1 | 6/2004 | Smith | |
| 2010/0230566 | A1 | 9/2010 | Neufeglise | |
| 2015/0334354 | A1 | 11/2015 | Uken et al. | |
| 2016/0144777 | A1 | 5/2016 | Carpenter et al. | |

OTHER PUBLICATIONS

Interior Warning Dash Light demonstrated at https://youtube.com/watch?v=w8pO1Lu8IFg, published Aug. 16, 2013.

* cited by examiner

RECONFIGURABLE VEHICLE CONTROL SYSTEM

TECHNICAL FIELD

The present application relates generally to a distributed control or electrical system, and more particularly to an adaptable wiring system for distributed control.

BACKGROUND

In many types of container based storage systems (e.g., rail cars, auto carriers, semi-trailers, and shipping containers), workers that load or unload the system have battery powered lighting devices attached to a helmet, much like a miner's helmet. Protective gear on workers is often required due to the confined space to perform loading and unloading operations, particularly in the field of vehicle loading and unloading. Protective head gear with added lighting may be a potential catch point in low clearance access areas of the storage system and can become a safety concern. The conventional helmet-based lighting system also provides limited illumination capabilities because such a lighting system illuminates only where the worker points the light in a dark area. This limited capability can result in a lack of illumination with respect to a variety of objects, including a trip hazard.

SUMMARY OF THE DESCRIPTION

The present disclosure is directed to a modular electrical system for a plurality of accessories disposable on a support structure. In one embodiment, the support structure is a reconfigurable support system, such as a reconfigurable auto carrier. The modular electrical system may include a central controller configured to control operation of a plurality of accessories based on one or more inputs, and a physical network layer operably coupled to the central controller, wherein the physical network layer enables transmission of control information relating to operation of the one or more accessories. The modular electrical system may further include an auxiliary node operably coupled to the network physical layer and in communication with the central controller. The auxiliary node may be configured to control operation of the plurality of accessories based on control information received from the central controller via the physical network layer.

In one embodiment, the modular electrical system may include a plurality of wiring harnesses electrically connected to the auxiliary node, where each of the plurality of wiring harnesses includes a plurality of wiring runs that are electrically connectable to at least one of the plurality of accessories. Each of the plurality of wiring runs may include a base section and a tail section configured to enable re-positioning of the at least one accessory. For instance, the tail section may enable movement of the accessory location based on reconfiguration of the reconfigurable support system.

In one embodiment, the modular electrical system may include at least one additional auxiliary node and a plurality of additional wiring harnesses both substantially identical to the auxiliary node and the plurality of wiring harnesses. The plurality of wiring harnesses and the plurality of additional wiring harnesses may be configured for operating groups of accessories in zones for areas of the support structure that are separate from and substantially identical to each other. For instance, in the context of an auto carrier having two levels, each level may be divided into four zones each with substantially the same layout as the corresponding zone in another level. The plurality of wiring harnesses and the plurality of additional wiring harnesses may be used in conjunction with either area, facilitating ease of maintenance and installation.

In one embodiment, the plurality of accessories may be a plurality of task lights for illuminating wheel chock engagement and/or securement areas of an auto carrier. The plurality of task lights may be activated in one embodiment to at least one of a) illuminate one or more of such areas and b) strobe to indicate an alert condition.

These and other advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION

An electrical system with modular wiring harness is described and shown in the illustrated embodiment of FIG.

1, and generally designated 100. The modular electrical system 100 may be utilized in connection with a variety of applications, including vehicle and vehicle related components, such as rail cars, trailers and implements. The electrical system may facilitate communication connection and command over a variety of accessories. As described herein, the accessories may be capable of communication via a communication bus or configured to function according to one or more direct inputs, or a combination of communication and one or more direct inputs. The one or more direct inputs may include a discrete input or an analog input, or a combination thereof. The modular electrical system 100 may be powered in a variety of ways, including, for example, at least one of a battery, solar cells, a fuel cell, and an AC power source.

Figure 10:
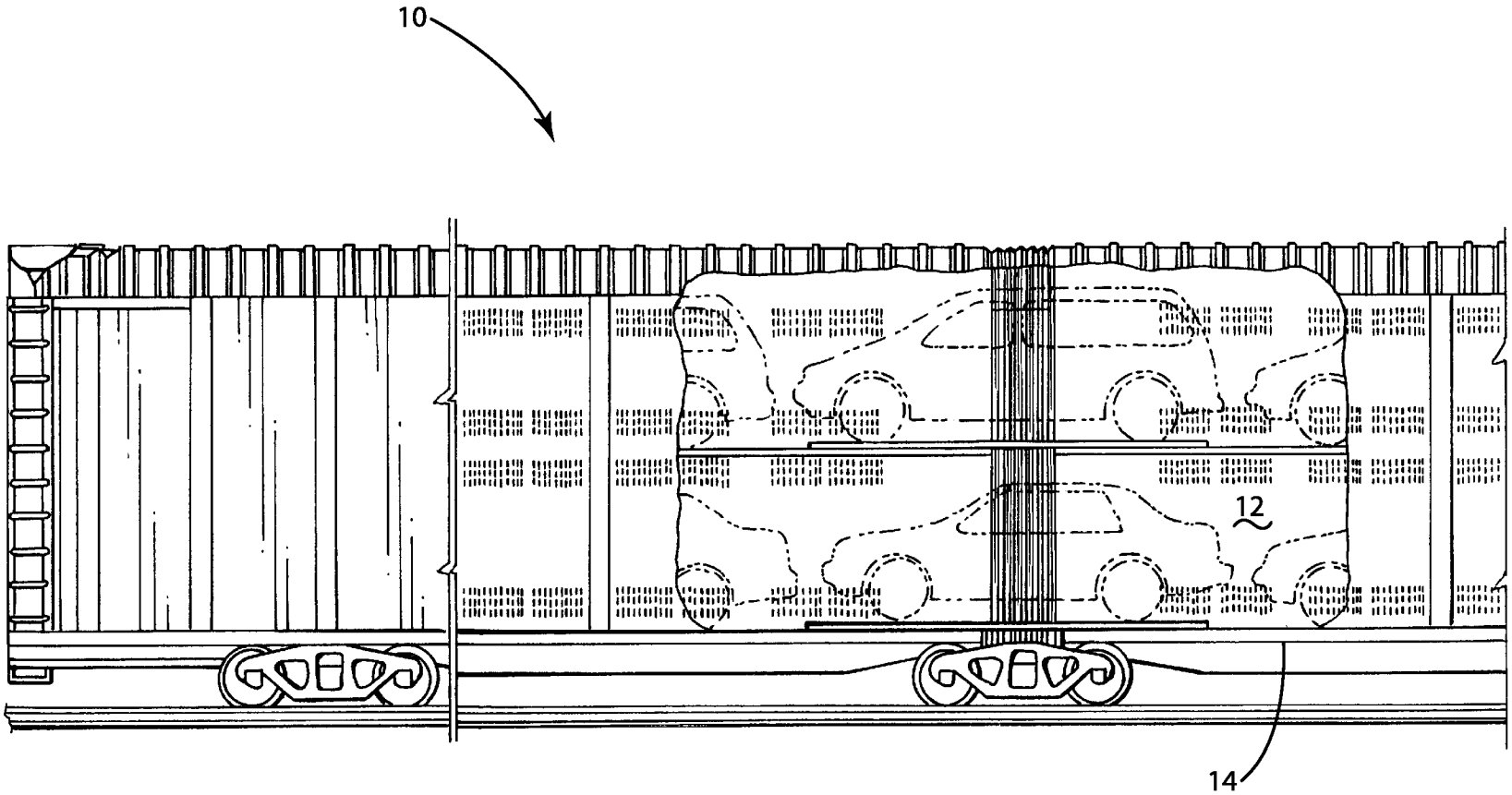
FIG. 10 is a side view of a conventional auto carrier.

The modular electrical system 100 may be implemented in connection with a support structure, such as a modular vehicle component that is reconfigurable by physically moving or rearranging one or more components. For instance, the modular vehicle component may be a railcar container with features inside that are physically movable such that the railcar container is configurable. More specifically, as depicted in the illustrated embodiment of FIG. 10, the modular vehicle component may be an auto rack or auto carrier 10 that forms a piece of railroad rolling stock used to transport vehicles, including automobiles and light trucks. The auto carrier 10 may include a base deck 14 and one or more reconfigurable decks 12 that support the vehicles for transportation. The one or more reconfigurable decks 12 may be raised or lowered relative to the base deck 14 to accommodate vehicles of different heights. For instance, the auto carrier 10 may be reconfigured from use for transporting sedans toward a configuration that accommodates light trucks whose overall height is greater than the sedans. It should be understood that the auto carrier 10 is not limited to rail-type automobile carrying systems—as an example, the auto carrier 10 may be a trailer pulled by a road vehicle, such as a tractor unit or truck.

The modular electrical system 100 may be configured to adapt along with the modular vehicle component without significant effort to cut or splice electrical wiring. Additionally, or alternatively, in the context of a container or closed space, the modular electrical system 100 may be configured to utilize a limited allocation of wiring space (such as wiring duct) in an efficient manner while providing adaptability for a variety of physical configurations. For instance, the modular electrical system 100 may include a plurality of drops along the length of the auto carrier 10 for each deck or level. Each of the drops may be associated with a task light for lighting an area in proximity to a wheel of each vehicle. With such lighting, an operator can more easily engage a wheel chock for maintaining position of the vehicle within the auto carrier 10. Because a deck 12 of the auto carrier 10 may raise or lower, and because the wheelbase of the vehicles being stored may be variable, the modular electrical system 100 may be configured to facilitate changing the locations of the task lighting along with movement of the deck 12 and different wheelbase lengths. In one embodiment, the modular electrical system 100 may facilitate such changes without requiring wire splicing or cutting, improving environmental robustness and reliability of the electrical system 100. The modular electrical system 100 may include just enough slack in available wiring to accommodate nearly all possible combinations of deck height and wheelbase line while also fitting within a limited amount of wiring space.

Figure 11:
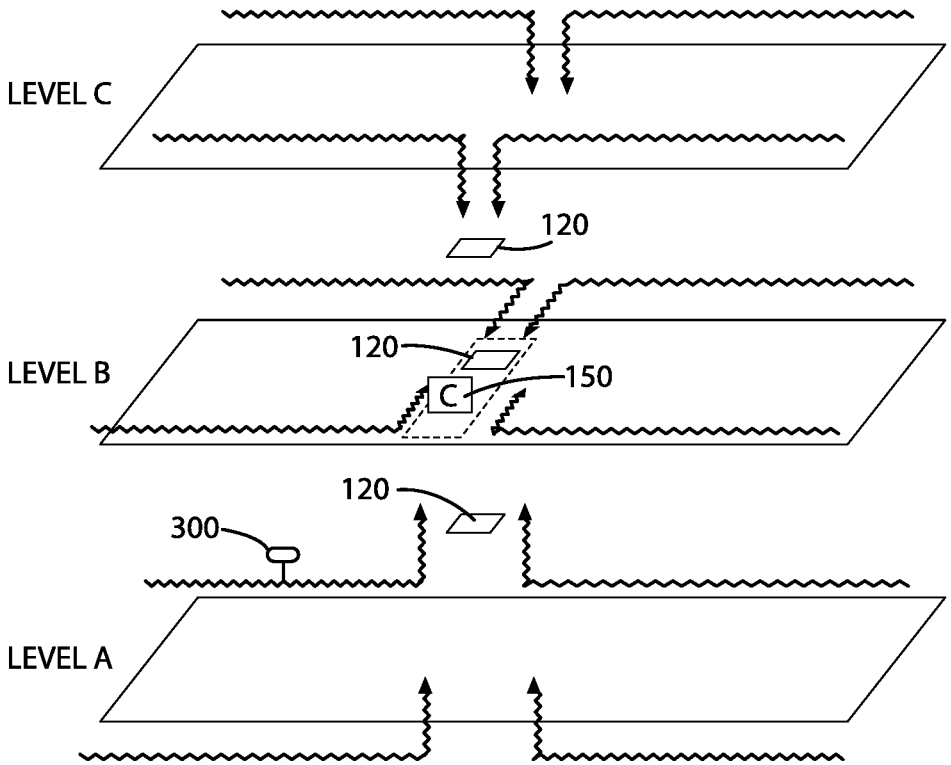
FIG. 11 is a method diagram of the modular wiring system according to one embodiment.

In one embodiment, the modular electrical system 100 may include a central controller 150, at least one auxiliary node 120, and one or more accessories 300 (e.g., light fixtures). The central controller 150 and the at least one auxiliary node 120 may be optimized to communicate with each other over a single multiplex bus wire (LIN standard). In the illustrated embodiment of FIG. 11, the modular electrical system 100 is shown with multiple wire harness segments (each substantially identical) that can be combined for different container configurations, such as different auto carrier 10 configurations. For instance, the pitch of illumination fixture spacing can vary and be accommodated within the modular electrical system. Additionally, or alternatively, dimensional variation with respect to changes in level height or deck height within the auto carrier can be accommodated by the modular electrical system 100. In one embodiment, the modular electrical system 100 may be configured to substantially minimize overall replacement and repair in the event of localized vandalism, where it may be necessary to replace only a portion of the wire harness. The routing of the wires may be configured such that the wires are out of visual sight and generally inaccessible. This is for the benefit of safety—to not entangle a worker, for reliability and robustness—to avoid wire contact with workers or vehicles, and to substantially reduce the possibility of vandalism—removing easy access to wires. The routing may be encased in electrical grade conduit and also may be routed in an advantageous channel that runs along the auto carrier 10 near the preferred vertical elevation and the azimuth from the vehicle tire and chock location.

In one embodiment, the routing may make use of existing channels for wire hiding and to retrofit the auto carrier 10. It should be understood that the routing may vary from application to application, and may facilitate fitting of newer or older auto carriers.

The storage support system may be a harsh environment, particularly in the realm of the auto carrier 10. The reality of an auto carrier 10 is exposure to harsh temperature extremes along with substantially constant vibration. The auto carrier 10 may also accumulate an oily residue on surfaces over time and use. Such accumulation can be periodically maintained with high pressure cleaning systems. The electronic system 100, including electronics, wire harnesses, and illumination fixtures, may be configured for such conditions to achieve a degree of operational reliability. The electronic system 100 may further be configured to be vandalism resistant.

I. Component Overview

Figure 1:
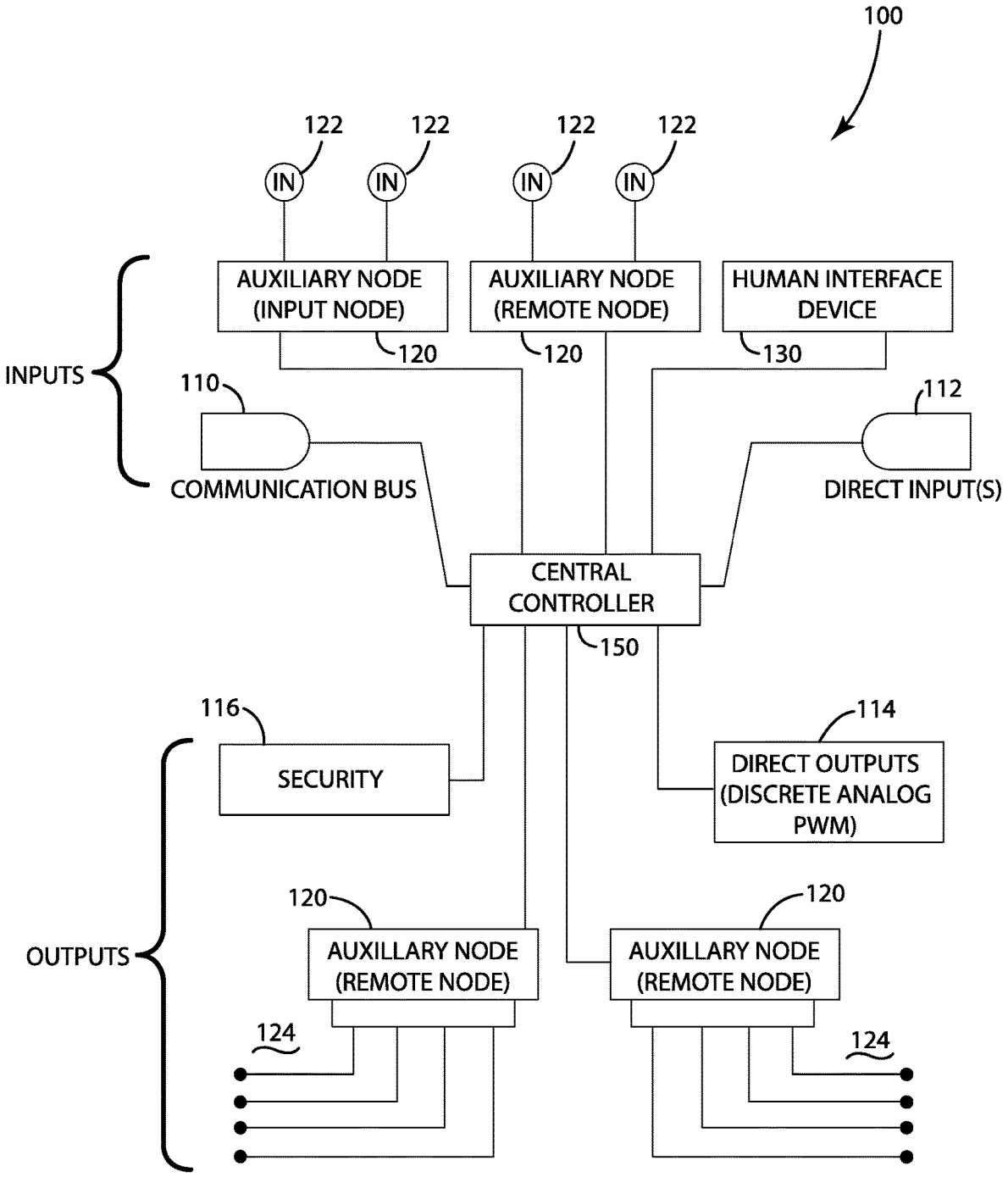
FIG. 1 is a representative view of input and output paths of a modular wiring system according to one embodiment.

A representative signal diagram of the modular control system 100 according one embodiment is depicted in FIG. 1. The modular electrical control system 100 in this embodiment may include a central controller 150 that is coupled to a variety of devices in a variety of ways to receive one or more inputs and provide one or more outputs. The central controller 150 may simply relay an input from one device to an output of another device, or may provide an output based on one or more received inputs, or a combination thereof. Further, the input may be a manually activated input or an automated input generated by a device.

In the illustrated embodiment of FIG. 1, the modular electrical control system 100 may include the central controller 150 in one or more devices. The devices may include at least one of a user input or human interface device 130, a control panel and an accessory node 120. As described herein, the devices may be configured to communicate via a communication interface (e.g., a wired or wireless network) or direct I/O.

An input may be received by the central controller 150 via at least one of one or more communication interfaces 110

(such as a communication bus) and one or more direct inputs 112. There may be more than one communication interface 110, such as a wireless or USB interface and a network bus interface. In the illustrated embodiment of FIG. 1, at least one auxiliary node 120 may communicate input information to the central controller 150 via a network bus separate from the communication bus 110.

The one or more direct inputs 112 may include a discrete input, such as an ON-OFF input from a limit switch, or an analog input from a sensor. In this way, the central controller 150 may receive one or more direct inputs 112 from non-bussed accessories or components.

In the illustrated embodiment, the at least one auxiliary node 120 may receive one or more inputs 122 in a direct manner similar to the one or more direct inputs 112. The one or more inputs 122, like the one or more direct inputs 112, may be discrete or analog, or a combination thereof. The one or more inputs 122 may correspond to inputs provided by accessories or components to the auxiliary node 120. Although described in connection with receiving input directly, the at least one auxiliary node 120 may receive inputs via one or more communication interfaces, bussed or non-bussed and wired or wireless, or any combination thereof. The at least one auxiliary node 120 may be an input type node or a remote, as described herein, and may facilitate transfer of information and/or control signals to and from the central controller. For purposes of disclosure, there are multiple auxiliary node 120 disposed on the input side central controller 150, and multiple auxiliary node 120 disposed on the output side of the central controller 150. It should be noted that the auxiliary node 120 on an output side may be the same auxiliary node identified on the input side. Likewise, the auxiliary node 120 identified on the output side may be different from the auxiliary node 120 identified on the input side.

Additional input to the central controller 150 may be received from a human interface device 130. The interface device 130 may communicate such input to the central controller 150 via a network bus shared with the at least one auxiliary node 120. It should be understood, however, that the present disclosure is not so limited, and that the human interface device 130 may communicate or provide input to the central controller 150 via any of the input paths described herein, including direct or via a separate communication interface. In one embodiment, the human interface device 130 may be disconnected from a separate power bus, and may receive power or operate via power received through the interface with the central controller 150. In the context of a network bus (e.g., a LIN bus), the human interface device 130 may operate based on power received from the network bus. This way, the human interface device 130 may be easily coupled to the central controller 150 without requiring a separate source of power, such as a battery or physical connection to a power bus or source.

The central controller 150 may provide one or more outputs via one or more output paths similar to those described in connection with the input paths. For instance, the output paths may include one or more direct paths 114, such as discrete outputs, analog outputs, and pulse width modulated (PWM) outputs, and at least one type of communication interface, such as a network bus. Although described in connection with a network bus, the communication interface may be any type of interface, including any combination of bussed, non-bussed, wired and wireless interfaces.

In the illustrated embodiment, the central controller 150 may also provide one or more specialized outputs dedicated for a specific type of device. For instance, the central controller 150 may be configured to provide at least one of input paths(s) and output path(s) particularly configured for operating with at least one security component 116 (e.g., actuating a siren that may be coupled to a speaker).

The one or more outputs provided by the central controller 150, in the illustrated embodiment, may be directed to at least one auxiliary node 120 via a communication interface, such as a LIN bus. It should be understood, however, that one or more outputs may be directed to an auxiliary node 120 in any manner described herein. The at least one auxiliary node 120 may be configured to provide at least one output 124 based on output received from the central controller 150. The at least one output 124 is depicted in the illustrated embodiment of FIG. 1 as a direct output, but the present disclosure is not so limited—the at least one output 1 point 4 from the auxiliary node 120 may be similar to or any combination of the output paths described herein in connection with the central controller 150.

It should be understood the illustrated embodiments of FIG. 1 may include additional network parts or exclude certain network parts based upon the particular equipment type. The modular networked control system 100 may be connected as a bus network 160 or other network topology. Any combination of some, all, multiple, or additional network parts may embody the modular networked control system 100.

II. Central Controller and Power Bus

Figure 3:
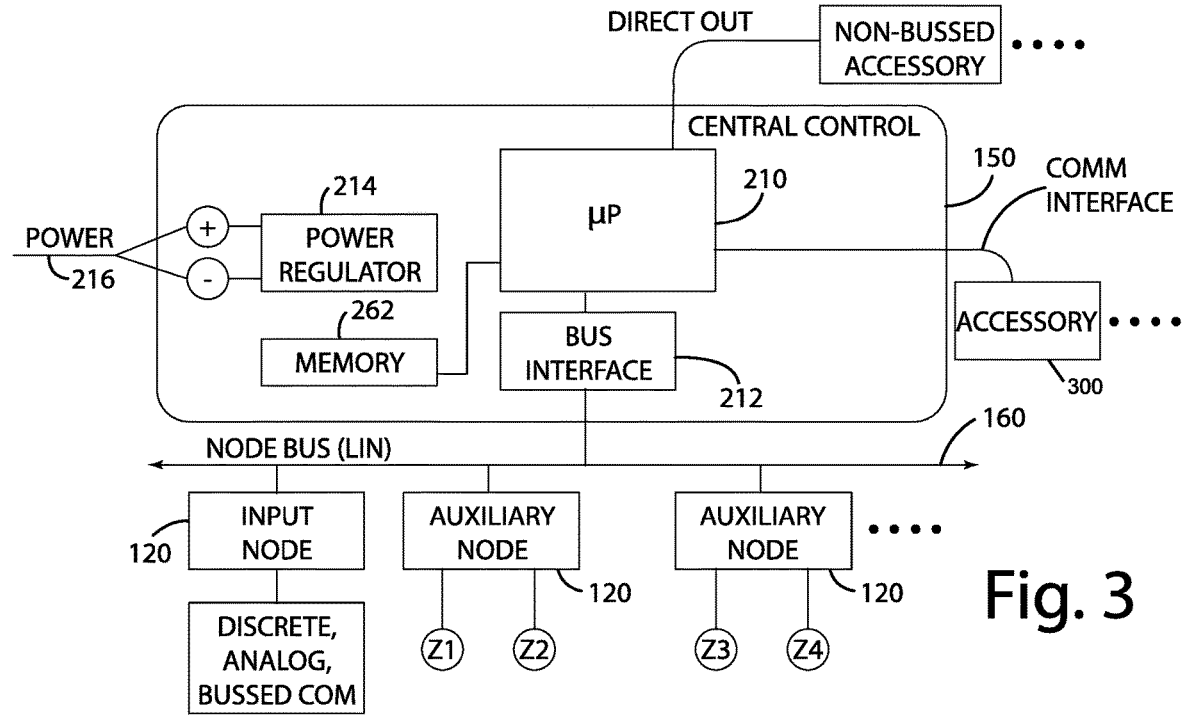
FIG. 3 is a schematic diagram of a central controller of the modular wiring system according to one embodiment.

The central controller 150 according to one embodiment of the present disclosure is described in further detail in connection with FIGS. 3-4. In the illustrated embodiment, the central controller 150 includes a controller 210, memory 262, power regulator circuitry 214 and communication interface circuitry 212. The controller 210 may receive inputs, and relay or process the inputs to provide one or more outputs as described herein. The power regulator circuitry 214 may be coupled to a power source 216 to regulate and provide power to circuitry of the central controller 150.

The communication interface circuitry 212 may include a network bus interface, such as a LIN bus interface or a CAN bus interface. The communication interface circuitry 212 may operably couple the central controller 115 to a network bus 160 to form one or more communication links with the at least one auxiliary node 120, which may be operably coupled to one or more accessories or devices 300 or zones Z1-4 of one or more devices. The central controller 150 may also include additional interfaces from the controller 210 to one or more accessories 300. The additional interfaces may include direct I/O paths and communication interface paths, as described herein. Example communication interface paths include diagnostic USB, serial, cellular, Wi-Fi, Li-Fi, global positioning system (GPS), and a wireless communication transceiver, receiver, or transmitter. Such communication interface paths may enable control signals to be provided to the one or more accessories 300 (such as task lights and sirens). In one embodiment, the one or more accessories 300 may communicate information via one or more of the communication interface paths described herein, including the network bus 160 and the wiring harness. As an example, a task light may be a smart light with one or more sensors capable of monitoring a characteristic of the smart light or a characteristic external to the smart light, or both. The one or more accessories 300 may include one or more sensors similarly arranged to monitor one or more characteristics, external, internal or both. Sensed information may be communicated via a physical network bus to another device, such as the auxiliary node 120 or the central controller 150, or both. In this way, the modular electrical system 100 may enable bidirectional communication with the one or more accessories 300 and one or more other components of the system 100.

Figure 4:
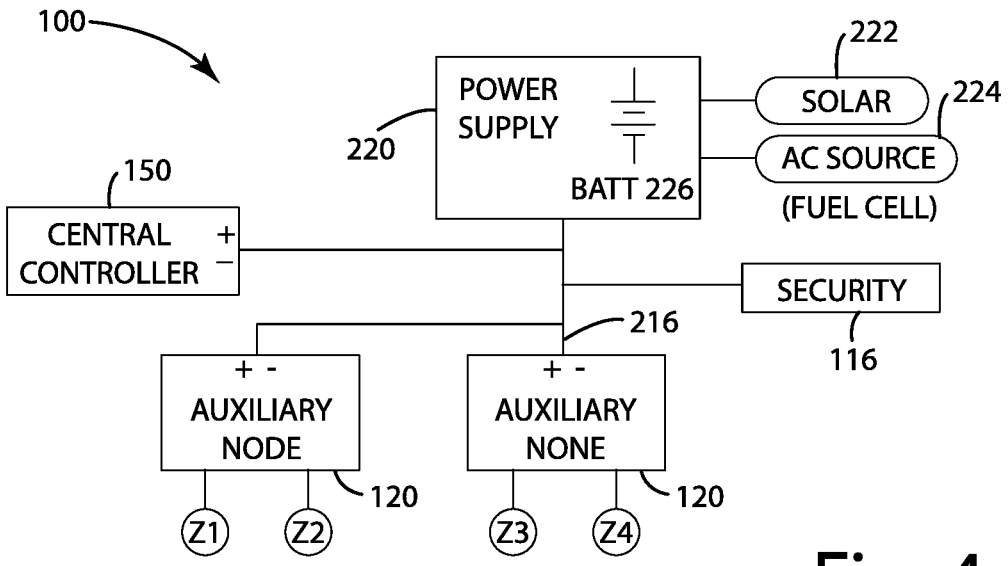
FIG. 4 is a schematic diagram of a power routing of the modular wiring system according to one embodiment.

In the illustrated embodiment of FIG. 4, the modular electrical system 100 may include a power bus system 216 that supplies power to the central controller 150 and the at least one auxiliary node 120. The power bus system 216 may also provide power to the one or more security components 116. The power bus system 216 may be sourced by a power supply 220 coupled to one or more power sources, including, for example, a battery 226, solar cells 222, and an AC power source 224. A combination of these power sources may be used to power the modular light 100. In one example, the modular electrical system 100 may include a battery 226 and solar cells 222 that function in conjunction with each other to provide power to an auto carrier 10 while in transit. In this context, there may be a limited supply of energy for powering all aspects of the modular electrical system 100, including one or more accessories 300. The central controller 150 may be configured to manage power in such limited energy circumstances, including controlling which accessories 300 are energized at any one time so as to reduce or manage the available energy supply. At the rail yard, the auto carrier 10 may be coupled to an AC power source 224 to charge the battery 226 and power the modular electrical system 100. The power supply 220 may include an AC converter to translate the AC power source to 224 to DC power for the system.

It should be noted that, in one embodiment, at least one of the auxiliary node 120 and the central controller 150 may manage power usage within the modular electrical system 100. This may involve managing the available supply of energy as discussed above. This may also involve controlling or limiting the current draw on the power supply to 20 from one or more sensors 300 and at any one time. For example, in the context of an auxiliary node 120 coupled to several accessory lights, the system 100 may control operation to avoid activating all of the accessory lights that any one time. In this way, the modular electrical system 100 may achieve load shedding, and avoid significantly overloading the power bus 216.

The central controller 150 in one embodiment may be configured to manage power to provide one or more of the following: a) maximum illumination for a given amount of power, b) step down illumination, and c) and battery power conservation for auto carriers 10 that have multiple configurations. The power management may monitor battery state, and adjust illumination modes accordingly. Example illumination modes include varying the degree of illumination (e.g., limiting the overall power provided to a light) and selectively controlling subsets of lights to activate and leave deactivated.

The central controller 150 according to one embodiment may manage a plurality of input paths and output paths. An example of such a system is described in U.S. application Ser. No. 14/299,261, filed Jun. 9, 2014, entitled EMERGENCY VEHICLE SIGNAL CONTROL SYSTEM, U.S. application Ser. No. 14/664,134, filed Mar. 20, 2015, entitled EMERGENCY VEHICLE ACCESSORY, AND U.S. application Ser. No. 15/013,390, filed Feb. 2, 2016, entitled EMERGENCY VEHICLE ACCESSORY—the disclosures of which are incorporated by reference in their entirety. One or more of the accessories 300 may be lights in one embodiment that each consume less than 20 mA of current. This amount of current is considered relatively low-although with a large number of potential lighting areas in the auto carrier field (e.g., perhaps 75 lighting areas spread over 3 decks each with 4 zones), there is a large scale physical space (e.g., shipping container, water vessel/ship, train car, semi-trailer, or box truck or straight truck). This large physical space may involve long wire runs as described herein, and the central controller 150 may manage power to avoid significant voltage drops over these long wire lengths. Some accessories may also consume more than 5 A of current, even up to 20 A while still having common central controller 150 behavior.

In one embodiment, the central controller 150 may be specifically configured for purpose-built rail lighting, and may manage a limited amount of power on a rail car in controlling illumination of work areas. The electrical system 100 may provide a customizable logic strategy, and provide a forward expandable (lighting, security, asset management system integration, connected vehicle) configuration for additional features/components envisioned at later stages after initial installation.

III. Auxiliary Node

The auxiliary node 120 is described in further detail in connection with the illustrated embodiment of FIG. 2. In one embodiment of the present disclosure, there are at least two types of auxiliary nodes 120: 1) an input type and 2) a remote type. The input type node may facilitate receipt of one or more inputs by the central controller 150 via the node bus 160. The input type node may be configured to operate from power received via the node bus 160 rather than a separate connection to a power bus 216. The input type node may receive inputs via any input path described herein, including the direct input and communication interfaces described herein. Although described as being an input type node for receiving inputs providing input based information to the central controller 150, it should be understood that the present disclosure is not so limited and that the input type node may also be configured to receive communication from a central controller 152 providing one or more control signals to activate one or more outputs.

Figure 2:
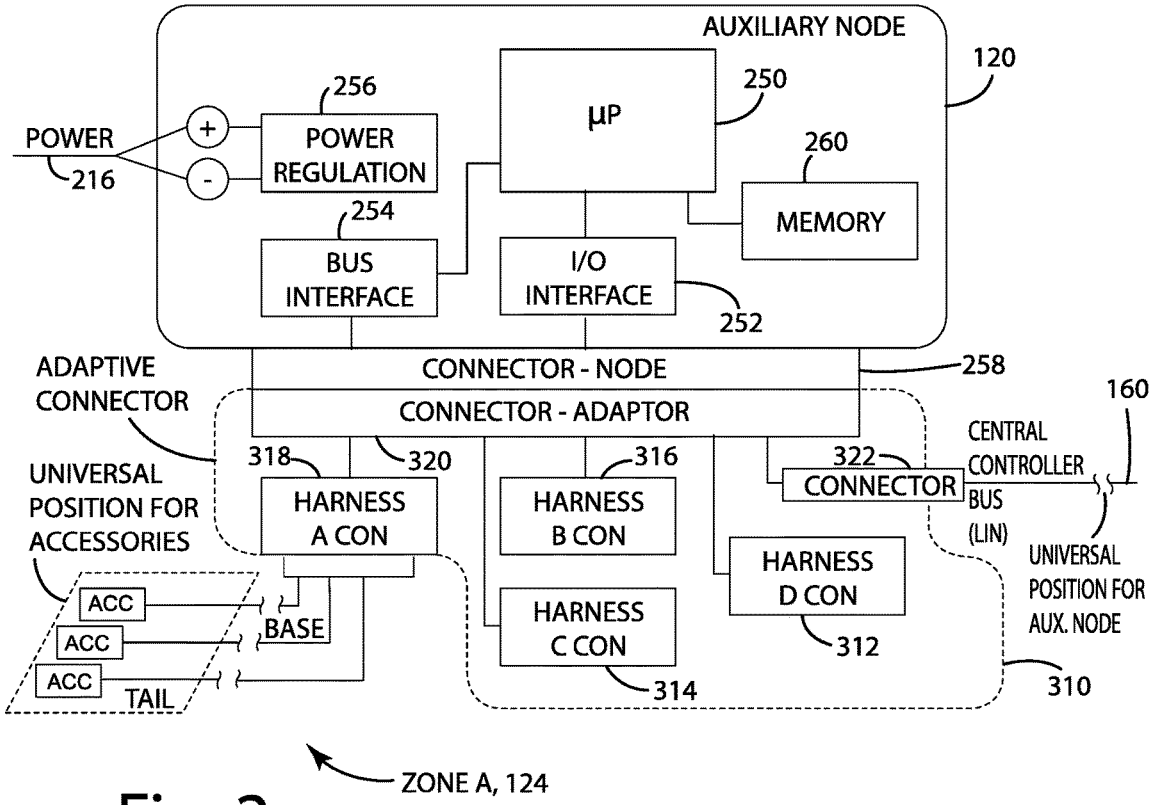
FIG. 2 is a schematic diagram view of an auxiliary node of the modular wiring system according to one embodiment.

A remote type node within the class of auxiliary nodes 120 is depicted in the illustrated embodiment of FIG. 2. The auxiliary node 120 in the illustrated embodiment of FIG. 2 includes a controller 250, memory 260, power regulation circuitry 256, communication interface circuitry 254, and I/O interface circuitry 252. The auxiliary node 120 may transmit and receive control signals according to any of the I/O paths described herein. In the illustrated embodiment, the communication interface circuitry 254 is a LIN bus interface operably to facilitate communication with the central controller 150. The power regulator circuitry then may be coupled to the power bus 216 to regulate and provide power to circuitry of auxiliary node 120.

The auxiliary node 120, as described herein, may facilitate distributed operation of one or more accessories 300 and collection of information or inputs by the central controller 150. The auxiliary node 120 of the central controller 150 may operate in conjunction with each other to achieve one or more of modes of operation with respect to the accessories 300. Rather than utilizing a bundle of dedicated I/O wiring from the sensors 300 to the controller 150, the auxiliary node 120 enables use of significantly fewer wires for a communication bus that can facilitate transfer of control signals from the central controller 150 to the auxiliary node 120, and ultimately to the one or more accessories 300. In this way, the amount of wiring needed to control the accessories 300 can be reduced significantly.

Further, it is noted that the physical connection of the auxiliary node 120 to the node bus 160 may be configured to provide a range of positionality with respect to the central controller 150 and auxiliary node 120. In one embodiment, the node bus 160 may include a defined amount of slack to facilitate movement of the auxiliary node 120 relative to the central node 150. The defined amount may be determined based on the available space for wiring and the range of movement desired. These two constraints may be driven by the object to which the electrical system 100 is fitted. In the context of an auto carrier 10, the available space for wiring may be constrained by the available conduit size and position, and the range of movement may be defined by the degree to which each of the decks for supporting vehicles are moved during reconfiguration.

In the illustrated embodiment of FIG. 2, the auxiliary node 120 may be coupled to at least one group of accessories that are identified by zones, Z, 124. In the case of an accessory 300 being a plurality of task lights for an auto carrier 10, each zone 124 may include a plurality of task lights arranged along some length of the auto carrier 10. The central controller 150 in auxiliary node 120 may selectively activate one or more of the task lights to illuminate an area of concern. The area of concern may be internal or external to the support structure (e.g., auto carrier 10). For instance, in the context of a firetruck with multiple storage areas that are externally accessible, the area of concern may be a portion of the exterior of the firetruck. For an auto carrier 10, this may include illuminating an area associated with storage and installation of a wheel chock for securing a vehicle. As another example, the central controller 150 and auxiliary node 120 may flash one or more of the task lights according to one or more patterns in response to a condition, such as a security breach condition. The one or more patterns may be selected to provide an external warning or indication of the security breach condition, and may also hinder cognitive operation of the likely intruder who initiated the security breach condition. The security breach condition may be provided to the electrical system 100 in a variety of ways including any of the I/O paths described herein. As an example, the security breach condition may be provided by a container door sensor that is armed to trigger a security breach condition in response to unauthorized opening of the container door.

The auxiliary node 120 may be configured to facilitate connections with one or more groups of accessories or zones that are configured to be nearly or entirely the same as each other, except for their physical locations. Each of the zones under control of the auxiliary node 120 may be associated with a respective harness A-D that each include an identifier or a differently configured connector such that each harness A-D can be easily, and likely without mistake, coupled to the auxiliary node 120 in a position identified with the physical location of the zone. Because the zones in this embodiment are largely the same, the control packet communicated from the central controller 150 to the auxiliary node 120 affect the states of the accessories 300 associated with each zone and can be simplified according to a zone address structure. For example, a left hand zone and a right hand zone associated with similar areas may have different zone addresses but similar accessory configurations such that the same bit position of a packet for each of these zones may correspond to similarly positioned accessories. In this way, the central controller 150 may communicate a state change with respect to both of the similarly positioned accessories by merely addressing the different zone, and without specialized programming for each zone. In other words, there may be a common structure in the packet used for communication between the central controller 150 and the auxiliary node 120.

In the illustrated embodiment, the I/O interface circuitry 252 of the auxiliary node 120 may control the actual state of outputs or receipt of inputs via a node connector 258. It should be understood that the I/O interface circuitry 252 described in connection with both inputs and outputs for purposes of disclosure, but the present application is not so limited—the I/O interface circuitry 252 may be configured only or solely for one or more outputs in one embodiment, or solely for one or more inputs.

For each accessory coupled to a respective output via the node connector 258, the auxiliary node 120 may source or sink power to activate the accessory. The I/O interface circuitry 252 may be configured to control and monitor the amount of current and level of voltage provided to the accessory. The I/O interface circuitry 252 in conjunction with the controller 250 may also determine one or more of all conditions in response to the monitored current and/or voltage. The auxiliary node 120 through the power regulator circuitry 256 may be the sole source of power for each accessory 300 coupled to the auxiliary node 120.

To facilitate correct connections between zones or groups of accessories 300 and the auxiliary node 120, the electrical system 100 may utilize an adapter harness 310. The adapter harness 310 may include keyed and/or colored connectors 312, 314, 316, 318 to identify correct or appropriate connections between respective zones and the auxiliary node 120. The connectors may be deutsch-type connectors. The adapter harness 310 may further include a node adapter connector 320 and a bus connector 322. The adapter harness 310 may be considered a breakout cable system that enables simple identification of appropriate connections, and includes wiring bundles for each respective harness connector associated with a group or zone of accessories 300. Alternatively, the adapter harness 310, or the node connector 258 may include a plurality of connector positions associated with each of the at least one harness connectors 312, 314, 316, 318 and the bus connector 322.

In the illustrated embodiment of FIG. 2, the harness connector A, 318 of the adapter harness 310 is depicted coupled to a zone A wiring harness 124. Each of the art connectors B, C, D (312, 314, 316) may be coupled to respective zones B, C, D in a similar manner. As shown, the zone A wiring harness 124 includes a base length and tail length that combined provide for variable positioning of each accessory 300 coupled to the zone A wiring harness 124.

The memory 260 of the auxiliary node 120 in the illustrated embodiment of FIG. 2 may be configured to store configuration information and operational instructions for the controller 210. Examples of the information that may be stored in the memory 260 include I/O mapping, zone layout, priority information for accessories 300, patterns for activating one or more light-type accessories (including activating one or more lights in a solid manner or strobing manner). Further examples of the information that may be stored in the memory 260 include timing information for controlling the accessories 300 (such as the timing for activating and deactivating one or more light type accessories), limits of operation for one or more respective accessories (such as a current limit and/or a voltage limit), and fault storage and/or fault criteria. It should be understood that information described as being storable in the memory 260 may be stored in the memory 210 of the central controller 150. For example, all or some of the configuration information described in connection with the auxiliary node 120 may be stored in the central controller 150. In one embodiment, the electrical system 100 may not include a central controller 150, and may utilize one or more auxiliary nodes 120 to perform the role of the central controller 150. In an alternative embodiment, the electrical system 100 may not include one or more auxiliary nodes 120, and may be configured such that the central controller 150 performs the role of the one or more auxiliary nodes 120.

IV. Accessory Device

The accessory devices 300 may be any type of device having at least one of one or more inputs and one or more outputs. The accessory devices 300 in one embodiment may be active visual devices or audio devices, or both, and may be operated based on commands received via a communication interface, such as the network bus 160, the communication interface circuitry 212, or the one or more communication interfaces 110, or a combination thereof, indirectly or directly. The accessory device 300 may include other types of devices, including, for instance, a global positioning system (GPS) or a wireless communication transceiver, receiver, or transmitter. Commands may be routed in a variety of ways, including, for example, from the central control unit 150 via the auxiliary node 120. It should be understood that the communication path to affect the state of an accessory 300 may involve both network communications and discrete signals. For example, the central controller 150 may communicate information used as a basis by the auxiliary node 120 to provide a discrete output to the accessory 300 to operate the accessory 300 in a particular manner, such as turning on a light output.

In one embodiment, the accessory 300 may be a functional warning unit that provides an alert. Such alert units can include lights, lightbars, sirens, horns, speakers, strobes, directional lighting, spotlights, etc. Other active visual and audible alert devices may be implemented depending on the specific requirements of the application, and can include public address systems, air horns and load lights.

V. Modular Wiring in Conjunction with Modular Container

Figure 5:
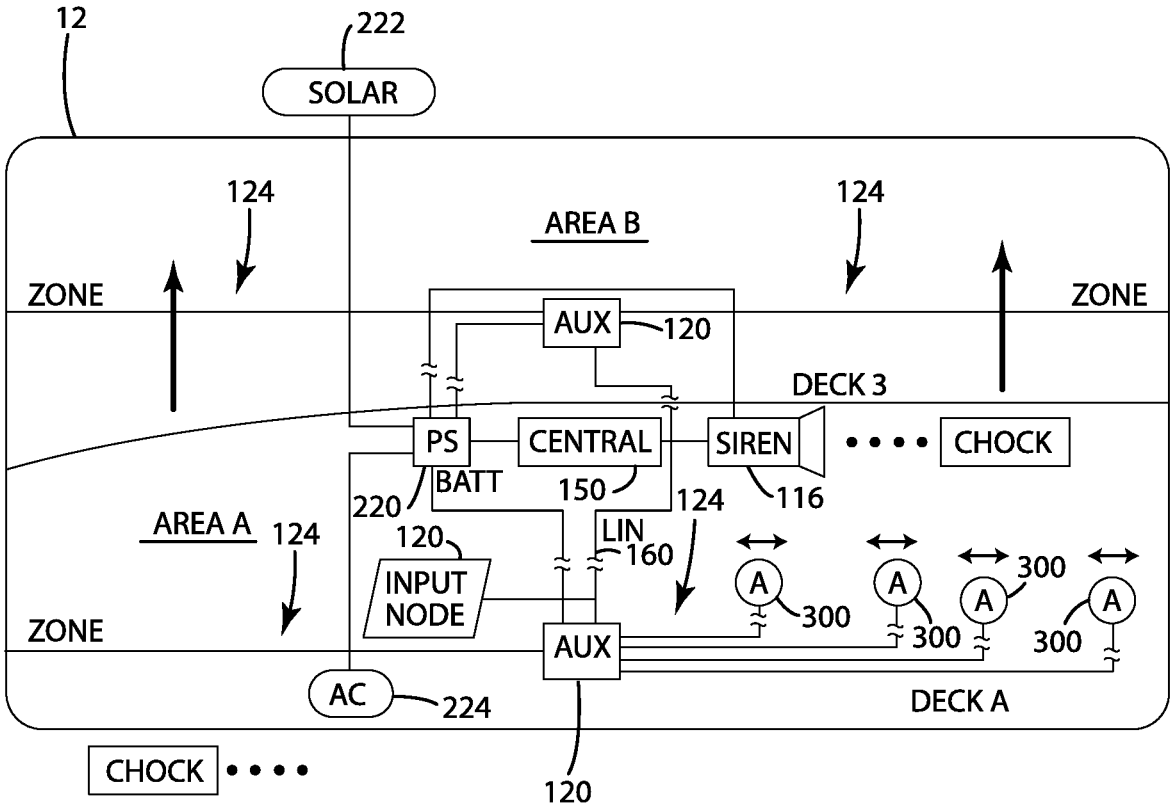
FIG. 5 is a representative view of the modular wiring system according one embodiment disposed on a container.
Figure 8:
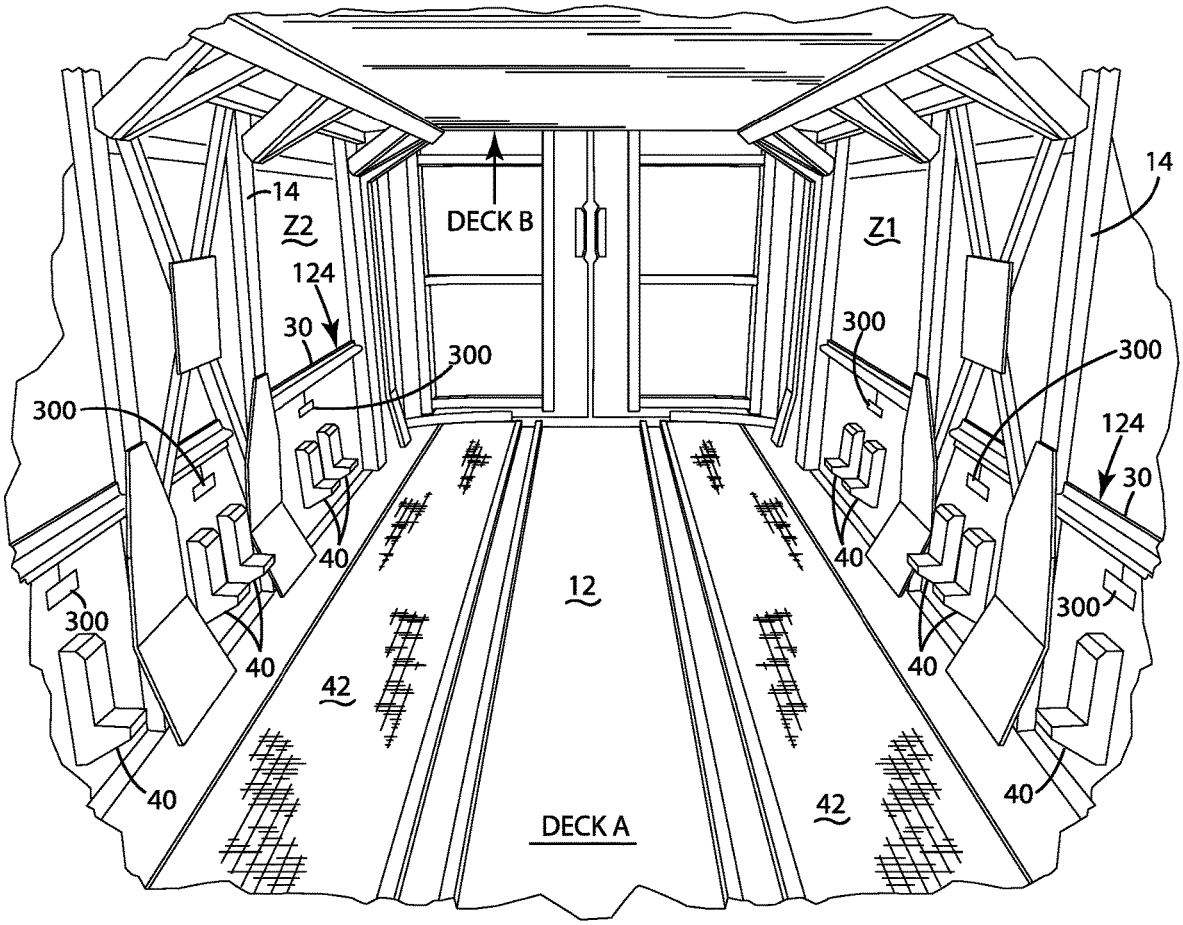
FIG. 8 is a perspective view of a container and the modular wiring system according to one embodiment.

A modular electrical system 100 according to one embodiment is provided and shown in conjunction with a modular container system 12 in FIGS. 5 and 8. The modular electrical system 100 in the illustrated embodiment provides a single harness format that performs for multiple types of auto carriers 10, including variants with different numbers of deck levels, different spacing of tire chocks, different types of user access (e.g., from the ground vs. on-board), and varying degrees and/or minimization of vandalism rework. The modular electrical system 100 may be outfitted on any type of support structure, examples of which are described herein, including an auto carrier and a presentation space. Some or all portions of the modular electrical system 100 may be fitted within the support structure, and some or all portions may be fitted outside the support structure.

The modular container system 12 in the illustrated embodiment includes two decks, deck A and deck B, and the height of deck B is reconfigurable upward or downward. The modular container system 12 may include one or more additional decks that are movable or reconfigurable alone or in conjunction with deck B. The modular electrical system 100 in this embodiment is configured to provide a plurality of accessories 300 configured as lighting fixtures disposed along the length of each deck of the modular container 12. Each of the decks of the modular container 12 are divided into zones Z1, Z2, Z3, Z4, and for purposes of disclosure, the plurality of accessories 300 are depicted with respect to the forward zone Z1 of deck A. Each of the zones of the modular container 12 may include a plurality of similar accessories 300 disposed in similar locations along the length of the respective zone. The plurality of accessories associated with the forward zone Z1 of deck A are disposed along a sidewall of the container 12 nearest to the face of the page. In this embodiment, there is another zone Z2 associated with the forward zone Z1 of deck A, but disposed along the opposite side wall of the container 12. The plurality of accessories 300 and the illustrated embodiment are spaced to provide task lighting within the container 12.

In the illustrated embodiment, each zone includes a plurality of wheel chocks 40 that are capable of being stored and secured to wheel support area 42 of the floor of the container 12 to facilitate immobilization of one or more vehicles within the container 12. The plurality of accessories 300 in the illustrated embodiment are spaced to be in general proximity to each of the stored wheel chocks 40 and the locations at which the wheel chocks 40 are secured to the floor of the container 12.

Deck B may be capable of being moved up and down relative to deck A. Placement of the accessories 300 as well as the auxiliary node 120 associated with deck B can be moved as well in accordance with one embodiment of the present disclosure. The physical layer of the network bus 160 may be sufficiently long to enable the auxiliary node 120 associated with deck B to be moved up and down along with deck B.

With deck B moving, the locations of the task lighting associated with the zones 124 of the deck be may be considered suboptimal, meaning if deck B lowers, the task lighting, if not moved, would be located well above the deck floor and likely not in substantial proximity to an area at which the wheel chocks may be installed. As described herein, the wiring harness for each of the zones Z1, Z2, Z3, Z4 may include a base length and a tail length, where the baseline is determined based on an area of coverage for a particular accessory 300, and the tail length is determined based on degree of spatial freedom with respect to the accessory 300 in that area of coverage. The tail length may enable the accessory 300 to be moved up, down and side-to-side to accommodate various positions of deck B.

At some point in use, the locations of the deck accessory 300 in zones along the length of the container 12 may be considered less than optimal for the particular use. For instance, if the locations of the accessory 300 are determined based on storage of trucks with a generally long wheelbase, and the container 12 is reconfigured for use with coupes having generally shorter wheelbases in the vehicle realm, the locations of the accessories 300 to provide lighting in proximity to vehicle wheels may be considered suboptimal. In this case, the tail length of the zone harness 124 for each accessory 300 may facilitate movement of the accessories 300 to enable reconfiguration for the particular use.

The modulator electrical system 100 in the illustrated embodiment includes a central controller 150, an auxiliary node 120 associated with each of the respective decks A and B. The central controller 150 in the auxiliary nodes 120 may be communicatively coupled via the network bus 150 (e.g., LIN bus). The modulator electrical system 100 may further include a power supply 220, a solar cell 222, the power source 224, security component 116 and an input type node 120. It should be understood that any one of the components depicted in connection with the illustrated embodiment of FIG. 5 may be included or excluded in one or more embodiments according to the present disclosure. Further, any component described herein may be further included in the modular electrical system 100 in the illustrated embodiment of FIG. 5.

The central controller 150 as well as the auxiliary node 120 may be disposed near the center line of the container 12 in order to avoid significantly long wiring runs relative to other wiring runs within the modular electrical system 100. This way, the modular electrical system 100 may avoid significant voltage drops along relatively long wiring runs between the auxiliary node 120 and an accessory 300. Significant voltage drops can adversely affect operation of the one or more accessories 300, such as by resulting in insufficient operational voltage for the accessory 300 potentially causing intermittent operation or failure to operate. In designing the system, there is a balance among several factors such as the number of runs, the number of harnesses, the gauge of the wire, and the voltage and current anticipated on each wire. The system according to one embodiment may reduce the number of different harnesses and reduce voltage losses, possibly to avoid use of larger gauge wire.

In one embodiment, the container 12 may be the auto carrier 10 as described herein. The auto carrier 10 often includes small perforated holes in the outermost side wall. These holes let in some amount of light while reducing contamination and vandalism on the newly manufactured vehicles inside.

Conventionally, work within the auto carrier 10 involves task execution in a confined space. The tasks may include the loading and unloading of motor vehicles. The detailed task involves careful separation (3" is typical) of vehicles, and securing each vehicle to prevent movement during transportation. Often times, the tires of the vehicle are restrained by at least one of two methods: 1) a belt strap over the tire/wheel and 2) a chock system. Visibility for the worker can be compromised in this setting, even with a helmet mounted "miners" type light. The primary reason for compromised visibility is that high brightness headlights of the vehicles can create contrast issues, and bending down for the chock installation is conducted in a confined space where moving a helmet based illumination system back and forth can be impractical. As a result, loading and unloading of vehicles is primarily performed during the daytime, with only limited nighttime operations in order to maintain a degree of safe operation.

With respect to wheel chock systems, such as the wheel chock 40 depicted in FIG. 8, where the wheel chock 40 can be stored on a wall storage system, and may be deployed to chock the tires of a newly manufactured vehicle. In many cases, the wheel chock 40 for the front of a vehicle is different from the rear wheel chock 40. For visual reference, the front wheel chock 40 may be color labeled with green marking, and the rear wheel chock 40 with red marking. This is one of several visual tasks a worker performs to manage in both daytime and nighttime loading scenarios for the auto carrier 10.

Additionally, it is noted that high value motor vehicles are often subject to vandalism when loaded train cars are left in train yards during normal logistics of train transport. In one embodiment, the electrical system 100 may be configured to enable security features with smart sensors. Conventional auto carriers 10 do not have electrical sources of energy. The electrical system 100 may include a power source 220, and may include capabilities to manage distribution of power and power usage within the electrical system 100. For example, if batteries 226 were added with a solar panel recharge system 222, the power draw of lighting and security components may consume more energy from the batteries than the solar panels could replenish into the batteries for a given period of time. The electrical system 100, including for example the central controller 150, may manage power as part of the functional task management. In other words, a train car, much like other large physical container type spaces, often is not fitted with an electrical platform or architecture. The electrical system 100 may address the infrastructure issue of power.

VI. Universal Positioning

Figure 6:
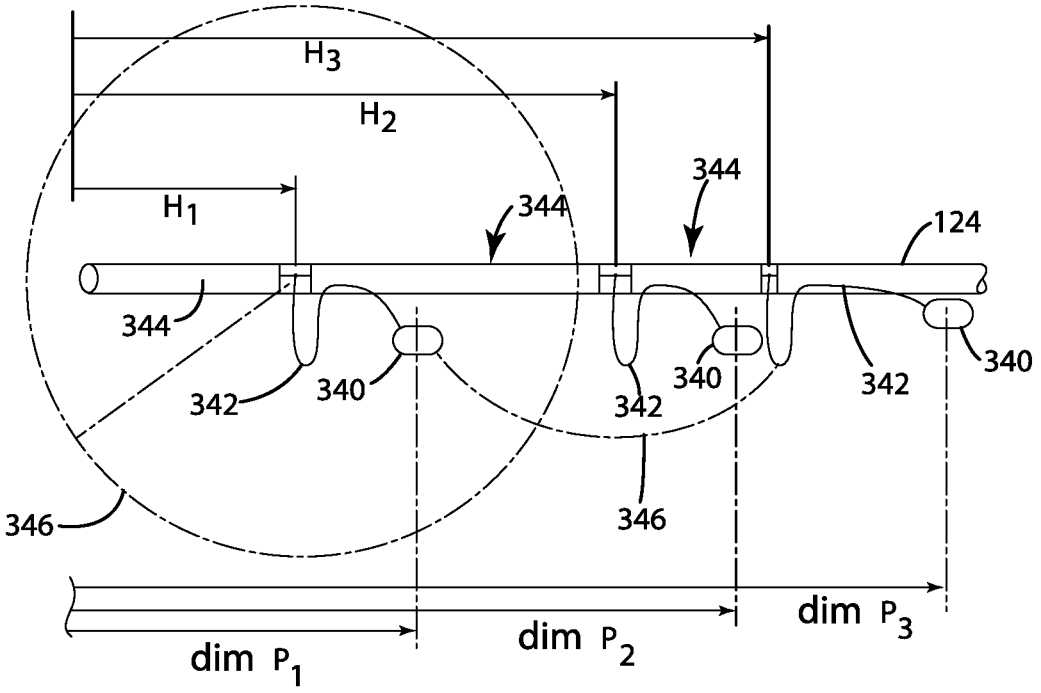
FIG. 6 is a representative view of a section of the modular wiring system according to one embodiment.
Figure 9:
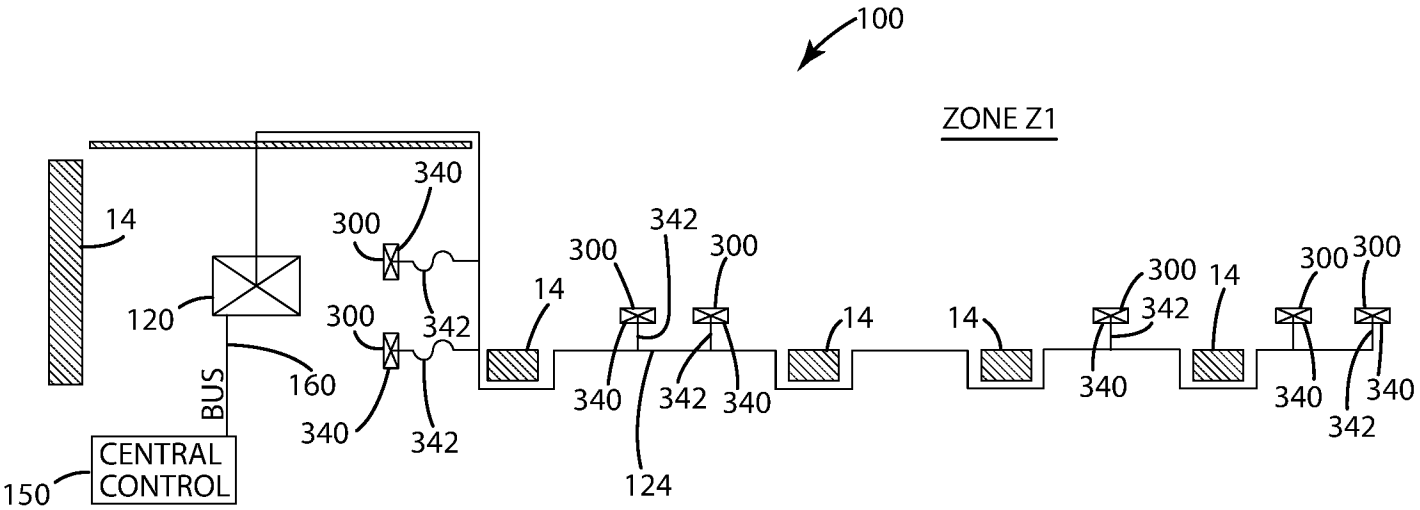
FIG. 9 is a schematic diagram of a section of the modular wiring system according to one embodiment.

A section of a zone according to one embodiment of the present disclosure is described and shown in connection with FIGS. 6 and 9. In the illustrated embodiment, the wiring harness 124 for the zone is shown configured for disposition along a longitudinal length of the container 12. It should be understood, however, that the present disclosure is not so limited, and that the wiring harness 124 may be configured for use in conjunction with a variety of applications, including applications in which components of the associated structure are static, and including applications in which components of the associated structure are reconfigurable, such as modular rooms, modular trailers, and modular implements (e.g., farming or construction implements).

The wiring harness 124 as described herein may include a plurality of wiring runs, one for each accessory 300. The ultimate length of each wiring run may vary within the wiring harness 124 in order to provide a plurality of accessory connectors at a plurality of separate locations. Each wiring run within the zone wiring harness 124 may terminate with an auxiliary node connector interface 340. The auxiliary node connector interface 340 may provide interface capabilities between the auxiliary node 120 and the accessory 300 according to any of the I/O paths described herein. In the illustrated embodiment, the auxiliary node connector interface 340 may provide a ground connection and an output connection to an output source under control of the auxiliary node 120.

Each wiring run of the wiring harness 124, as discussed herein, may include a base section 344 and a tail section 342 with lengths determined based on a variety of factors, including the harness locations H1, H2, H3, the accessory locations P1, P2, P3 and the available space for the wiring harness 124 (e.g., within electrical ducting in proximity to the harness locations H1, H2, H3). The length of the base section 344 may depend primarily on the harness location H1, H2 H3, at or near which the tail section 342 of the wiring run can break out from the wiring harness 124. In some circumstances, the harness location H1, H2, H3 may be determined based on a desired number of accessories for a given run and any potential obstructions for the run (e.g., placement of posts or structural framing such as the framing 14 of the auto carrier 10 depicted in FIGS. 8-9). The larger the number of desired accessories, the greater the number of harness locations H1, H2, H3. The harness locations H1, H2, H3 may be generally evenly spaced over a run or zone. But, in some cases, particularly in circumstances where obstructions exist in the zone, one or more locations H1, H2, H3 may be shifted to increase or decrease the spacing in one or more sections of the zone, such as a section in close proximity to an obstruction.

As indicated above, the length of the base section 344 may correspond primarily to the distance from the auxiliary node 120 or auxiliary adapter connector 310 to the harness location (e.g., H1, H2 or H3) for an accessory 300. And, the length of the base section 344 may depend on a variety of factors as indicated above. Turning to the tail section 342, the length of the tail section 342 of each wiring run or accessory run of the modular harness 124 may also depend on a variety of factors, including, for example, the spacing between the harness locations H1, H2, H3, the degree of freedom desired for the accessory 300 connectable to the wiring run, and the amount of space allocated within a wire duct for the wiring harness 124. The tail length sections 342 in conjunction with the base length sections 344 for the wiring harness 124 may be configured such that significant spatial freedom can be achieved for placement of a plurality of accessories along the zone. In one embodiment, such spatial freedom may be achieved while reducing overall usage of wire and adhering to available space constraints (e.g., space allocated within a wiring duct for the wiring harness 124).

Each tail section 342 of the wiring harness 124 may enable placement of an accessory within a range 346. It should be noted that the tail sections 342 of the wiring harness 124 may be generally uniform or may vary with respect to some or all of the harness locations H1, H2, H3. As an example, variance in the length of one or more tail sections 342 may enable spatial freedom with respect to one or more associated accessory locations in cases of obstructions. The range 346 associated with and defined in part by the length of each tail section 342 may enable connection and placement of an accessory 300 to accommodate changes in the surrounding structure, such as a reconfiguration and movement of the surrounding structure. For instance, in the case of container 12, raising the deck B may also involve raising the height of the accessories 300 (e.g., task lighting) in each zone associated with the deck B so that the distance between the deck B and the accessories 300 can be substantially maintained. In one embodiment, the length of the tail sections 342 and the defined ranges 346 may be configured to accommodate a known degree in variation of the deck B. For purposes of disclosure, the wiring harness 124 is described in conjunction with a movable deck B, but it should be understood that other movable features or components of the associated equipment (e.g., container 12) may be utilized in conjunction with the wiring harness 124.

In addition to or alternative to changes in the associated equipment, the wiring harness 124 may be configured to adapt to variability in field of use for the equipment. For instance, in the context of the container 12, if the type of vehicle being stored therein changes and includes a different wheelbase length, the length of the tail section 342 may facilitate movement of the accessories 300 to align generally with the wheels of the different vehicle.

With the adaptability of the wiring harness 124 to a variety of positions for accessories 300, the plurality of wiring harnesses 124 within the modular electrical system 100 may enable universal positioning of accessories 300 in conjunction with the associated equipment (e.g., the container 12). Excess length of the tail sections 342 may be tied up or disposed within the wire duct. The wire duct may provide limited space, and the wiring harness 124 and the length of the tail section 342 may be determined to provide potential universal positioning while maintaining access wireline within the wire duct and without exceeding available space limitations within the wire duct.

VII. Retrofit Option

It is further noted that the electrical system 100 may facilitate retrofitting of existing support structures, such as the auto carrier 10 or a semi-trailer. Auto carriers 10 often have life spans of approximately 50 years. Semi-trailers have typical lifespans of 10-20 years. The electrical system 100 may be retro-fit to such a large mobile platform, while addressing issues, as discussed herein, such as power access, the harsh use case environment, and market pressure to maintain historical operational use cases.

Figure 7:
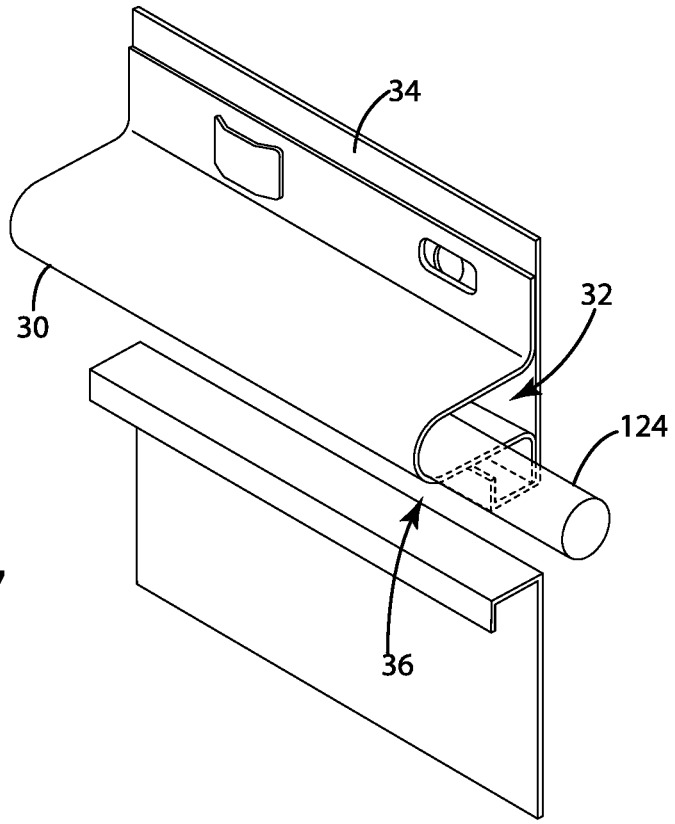
FIG. 7 is a perspective view of a routing option to retrofit a system according to the modular wiring system of one embodiment.

In the illustrated embodiment of FIG. 7, a retrofit option for routing the wiring harness 124 according to one embodiment in conjunction with the auto carrier 10 is shown. The auto carrier 10, as depicted in the illustrated embodiment of FIG. 8, may include one or more car panel bumper guards 30 disposed along substantial longitudinal sections of the auto carrier 10. The car panel bumper guards 30 are configured to substantially prevent damage to vehicle panels (e.g., vehicle doors) during loading and transit within the auto carrier 10. Many conventional auto carriers 10 are fitted with such car panel bumper guards 30.

The conventional construction of the auto carrier 10 often provides little room for inclusion of additional components, such as task lighting and the modular electrical system 100. The limited room provided within the auto carrier 10 is generally a function of the limited size constraints of the auto carrier 10 to comply with rail carrier regulations and the size of the vehicles being transported.

In one embodiment according to the present disclosure, the wiring harness 124 for a zone may be disposed at least partially within a cavity or channel 32 defined by the car bumper guard 30. In this way, the modular electrical system 100 may be retrofitted to an auto carrier 10 within a space that is available but not utilized completely, and that enables out of sight placement of a majority of the wiring harness 124. Because the car bumper guard 30 is generally constructed with a pliable, flexible material, the tail sections 342 may break out from the wiring harness 124 and exit through the top 34 or bottom 36 of the car bumper guard 30 in proximity to the harness locations H1, H2, H3. As discussed herein, the channel 32 may provide a limited space within which the base and tail sections of the wiring harness 124 can be stored. For instance, the channel 32 may have a cross sectional area of about 2 $cm^2$. The length of the tail section and the number of wiring runs may be determined based the desired degree of spatial freedom while enabling substantial concealment of the base and unused tail sections of the wiring harness 124 within the channel 32.

Retrofitting or disposing portions of the wiring harness 124 within the channel 32 allows the wiring harness (with or without electrical conduit encasement) to be concealed and protected in the soft bumper material cavity area 32 created by the bumper material and the sidewall panel of the auto carrier 10. This may enable a single deck of an auto carrier 10 to be built with four identical wire harnesses 124, one for each zone. In one embodiment, each of the wiring harnesses 124 may include predefined connectors for attaching to an accessory 300, such as a rail purpose built light fixture at multiple locations, and may also include a mating connector to attach to the auxiliary adapter connector 310, the auxiliary node 120, or the central controller 150, or any combination thereof. For an auto carrier 10 that may have up to three vehicle carrying decks, each deck of a multiple deck auto carrier 10 may be interchangeably outfitted with the same arrangement of wire harnesses 124. As an example, in the context of an auto carrier 10 having three decks, a total of twelve wire harnesses 124 (each substantially identical) may provide full coverage of wheel chock lighting areas.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A modular electrical system for a plurality of accessories disposable on a support structure, said modular electrical system comprising:

a central controller supported by the support structure, the central controller configured to control operation of a plurality of accessories based on one or more inputs, the plurality of accessories being independently positionable with respect to each other;

a physical network layer operably coupled to the central controller, the physical network layer enabling transmission of control information relating to operation of one or more of the plurality of accessories;

an auxiliary node supported by the support structure, the auxiliary node operably coupled to the physical network layer and in communication with the central controller, the auxiliary node being configured to control operation of the plurality of accessories based on the control information received from the central controller via the physical network layer; and a plurality of wiring harnesses electrically connected to the auxiliary node, each of the plurality of wiring harnesses including a plurality of wiring runs, each of the plurality of wiring runs being electrically connectable via an electrical connector to at least one of the plurality of accessories to provide a direct connection between the auxiliary node and the at least one accessory, wherein the each of the plurality of wiring runs includes a base section and a tail section configured to enable re-positioning of the at least one accessory, the tail section including the electrical connector for electrically connecting to the at least one accessory of the plurality of accessories, wherein the electrical connectors of the plurality of wiring runs are independently positionable relative to each other such that the electrical connector associated with each of the at least one accessory of the plurality of accessories is independently positionable relative to another electrical connector and an associated at least one accessory of the plurality of accessories, wherein the central controller, the auxiliary node, and the plurality of wiring harnesses are supported by the support structure, wherein the support structure is operable to support one or more objects in addition to the central controller, the auxiliary node, and the plurality of wiring harnesses, wherein the one or more objects are removably supported by the support structure, and wherein the plurality of wiring harnesses are substantially identical to each other except for differences in auxiliary node connectors forming an electrical connection with the auxiliary node, wherein each of the auxiliary node connectors includes an identifier that indicates a zone associated with the respective wiring harness.

2. The modular electrical system of claim 1 wherein the plurality of accessories are disposable along a longitudinal axis of the support structure, wherein a length of each base section of the plurality of wiring runs is determined based on a number of the plurality of accessories along the longitudinal axis, wherein the length of the base section of each of the wiring runs are different from each other.

3. The modular electrical system of claim 2 wherein a length of the tail sections of the plurality of wiring runs is determined based on the number of the plurality of accessories disposable along the longitudinal axis and a degree of spatial freedom associated with the support structure in proximity to the at least one accessory connectable to the tail section, wherein the length of the tail section is constrained by an available amount of storage space within a wire duct for the wiring harness.

4. The modular electrical system of claim 1 wherein the plurality of accessories are task lights for illuminating an area of the support structure that is dedicated to at least one of storage and securement of a wheel chock, wherein communication with the one or more accessories is bidirectional.

5. The modular electrical system of claim 4 wherein the central controller is configured to initiate activation of at least one of the task lights in response to an input received via the physical network layer.

6. The modular electrical system of claim 5 wherein the central controller is configured to initiate a strobing effect with respect to all or a subset of the task lights in response to receiving a security alert input.

7. The modular electrical system of claim 1 wherein the support structure is an auto carrier for one or more vehicles, wherein the one or more objects removably supported by the auto carrier correspond to the one or more vehicles.

8. The modular electrical system of claim 1 further comprising a siren communicatively coupled to the central controller, wherein the central controller is configured to command activation of the siren to drive a speaker in response to an alert condition.

9. The modular electrical system of claim 1 wherein the identifier is formed by keying the auxiliary node connectors.

10. The modular electrical system of claim 1 further comprising at least one additional auxiliary node and a plurality of additional wiring harnesses both substantially identical to the auxiliary node and the plurality of wiring harnesses.

11. The modular electrical system of claim 1 wherein the support structure is a reconfigurable support system.

12. A modular electrical system for a plurality of accessories disposable on a support structure associated with a road vehicle, said modular electrical system comprising:

a central controller supported by the support structure, the central controller configured to control operation of the plurality of accessories based on one or more inputs, the plurality of accessories being independently positionable with respect to each other;

a physical network layer operably coupled to the central controller, the physical network layer enabling transmission of control information relating to operation of one or more of the plurality of accessories;

an auxiliary node supported by the support structure, the auxiliary node operably coupled to the physical network layer and in communication with the central controller, the auxiliary node being configured to control operation of the plurality of accessories based on the control information received from the central controller via the physical network layer; and a plurality of wiring harnesses electrically connected to the auxiliary node, each of the plurality of wiring harnesses including a plurality of wiring runs, each of the plurality of wiring runs being electrically connectable via an electrical connector to at least one of the plurality of accessories to provide a direct connection between the auxiliary node and the at least one accessory, wherein the each of the plurality of wiring runs includes a base section and a tail section configured to enable re-positioning of the at least one accessory based on changes in the configuration of the support structure associated with the road vehicle, the tail section including the electrical connector for electrically connecting to the at least one accessory of the plurality of accessories, wherein the electrical connectors of the plurality of wiring runs are independently positionable relative to each other such that the electrical connector associated with each of the at least one accessory of the plurality of accessories is independently positionable relative to another electrical connector and an associated at least one accessory of the plurality of accessories, wherein the central controller, the auxiliary node, and the plurality of wiring harnesses are supported by the support structure, wherein the support structure is operable to support one or more objects in addition to the central controller, the auxiliary node, and the plurality of wiring harnesses, wherein the one or more objects are removably supported by the support structure, and wherein the plurality of wiring harnesses are substantially identical to each other except for differences in auxiliary node connectors forming an electrical connection with the auxiliary node, wherein each of the auxiliary node connectors includes an identifier that indicates a zone associated with the respective wiring harness.

13. The modular electrical system of claim 12 wherein the plurality of accessories are disposable along a longitudinal axis of the support structure, wherein a length of each base section of the plurality of wiring runs is determined based on a number of the plurality of accessories along the longitudinal axis, wherein the length of the base section of each of the wiring runs are different from each other.

14. The modular electrical system of claim 13 wherein a length of the tail sections of the plurality of wiring runs is determined based on the number of the plurality of accessories disposable along the longitudinal axis and a degree of spatial freedom associated with the support structure in proximity to the at least one accessory connectable to the tail section, wherein the length of the tail section is constrained by an available amount of storage space within a wire duct for the wiring harness.

15. The modular electrical system of claim 12 wherein the plurality of accessories are task lights for illuminating an area of the support structure.

16. A method of refitting a support structure to provide task lighting for the support structure, said method comprising:

providing a plurality of wiring harnesses electrically connected to an auxiliary node, each of the plurality of wiring harnesses including a plurality of wiring runs electrically connectable to a task light, each of the plurality of wiring runs including a) a base section that connects to the auxiliary node and extends along a sidewall of the support structure and b) a tail section that connects to the task light;

determining a position of an object support relative to sidewalls of the support structure;

raising or lowering the object support of the support structure relative to sidewalls of the support structure, wherein the support structure is operable to support the task light within the support structure; and repositioning the tail section and the task light associated with the tail section while substantially maintaining a position of the base section associated with the task light along the sidewall of the support structure, said repositioning including adjusting a location of the task light up or down along the sidewall based on a change in position of the object support of the support structure, said repositioning including utilizing more or less slack of the tail section to adjust the location of the task light.

17. The method of claim 16 comprising providing a wiring run of the plurality of wiring runs electrically connectable to an accessory other than the task light.

18. The method of claim 16 comprising determining a length of each base section of the plurality of wiring runs based on a number of the task lights being disposed longitudinally along the sidewall of the support structure, wherein the lengths of the base sections of the wiring runs are different from each other.

19. The method of claim 16 comprising determining a length of the tail section of the plurality of wiring runs based on a number of the task lights being disposed longitudinally along the sidewall of the support structure and a degree of spatial freedom associated with the support structure in proximity to the task light connectable to the tail section, wherein the length of the tail section is constrained by an available amount of storage space within a wire duct for the wiring harness.

20. The method of claim 16 wherein the object support is operable to support portable equipment within the support structure, and comprising, reconfiguring the support structure for a type of portable equipment to be loaded into an interior space of the support structure by longitudinally repositioning the tail section and the task light associated with the tail section while substantially maintaining the position of the base section associated with the task light along the sidewall of the support structure, said repositioning including adjusting the location of the task light forward or backward along the sidewall based on the type of portable equipment to be loaded.

21. The method of claim 20 wherein the portable equipment is a vehicle, wherein the support structure is towed by a vehicle, and wherein the object support is a vehicle support deck for supporting the vehicle within the support structure.

* * * * *